United States Patent [19]

Mayhew

[11] Patent Number: 4,962,787

[45] Date of Patent: Oct. 16, 1990

[54] FLUID FLOW REVERSING AND REGULATING RING

[75] Inventor: Phillip A. Mayhew, Sayre, Pa.

[73] Assignee: Ingersoll-Rand Company, Woodcliff Lake, N.J.

[21] Appl. No.: 325,656

[22] Filed: Mar. 17, 1989

[51] Int. Cl.[5] ..... F01C 13/02

[52] U.S. Cl. ..... 137/556.3; 137/270; 173/20; 173/170; 418/270

[58] Field of Search ..... 81/57.44; 173/20, 170; 137/269, 270, 556, 556.3, 559; 418/270

[56] References Cited

U.S. PATENT DOCUMENTS

| | | | |
|---|---|---|---|
| 735,719 | 8/1903 | Davis | 137/556.3 |
| 2,037,663 | 4/1936 | Lalor | 137/556 |
| 2,575,524 | 11/1951 | Mitchell | 418/270 |
| 3,402,779 | 9/1968 | Elmer | 173/170 |
| 3,480,087 | 11/1969 | Boeger | 173/20 |
| 3,827,834 | 8/1974 | Kakimoto | 418/270 |
| 4,822,264 | 4/1989 | Kettner | 418/270 |

*Primary Examiner*—A. Michael Chambers
*Attorney, Agent, or Firm*—Robert F. Palermo

[57] ABSTRACT

A fluid powered mechanism has a housing with a generally cylindrical shape and circumferentially adjacent axially extending primary and secondary fluid passageways. Exhaust direction and rotary limit speed are controlled by a flow reversing and regulating ring having a first face with a thru slot and an adjacent blocking flange and a second face having a turning flange which is the reverse of the blocking flange of the first face. The flow reversing and regulating ring is color coded to indicate the size of the fluid flow passageways and, thus, the limit speed provided by the ring. The rotational limit speed and the exhaust direction are determined by selection of the color-coded flow reversing and regulating ring and by its orientation in the tool.

21 Claims, 3 Drawing Sheets

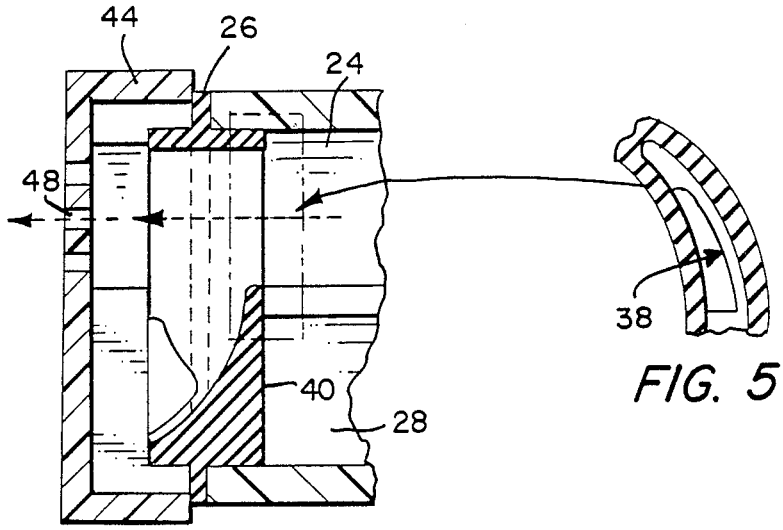
FIG. 5
FIG. 3
FIG. 4
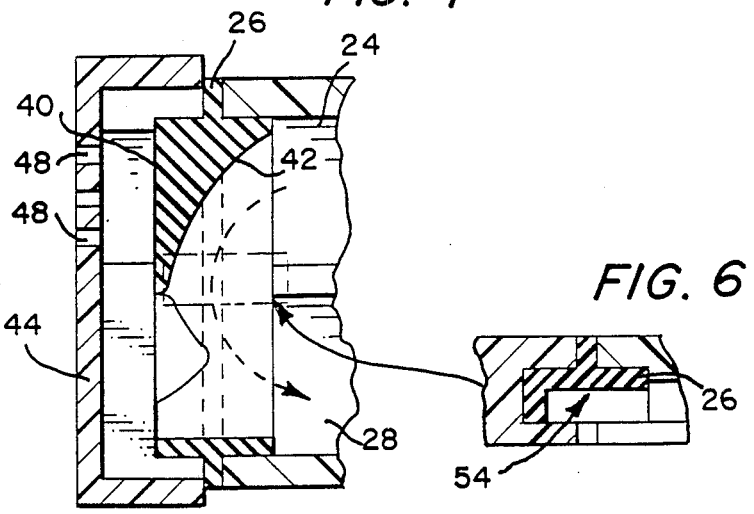
FIG. 6

FLUID FLOW REVERSING AND REGULATING RING

BACKGROUND OF THE INVENTION

The present invention relates to a fluid flow reversing and regulating ring for a fluid mechanism and in particular to an exhaust flow reversing and regulating ring for a handheld pneumatic power tool.

For some pneumatic power tools it is desirable to have a rear exhaust flow, while for other pneumatic tools it is desirable to have a front exhaust flow to clean the working area, for example. Some conventional tools use a valve to reverse the flow of exhaust fluid. Other known tools are constructed solely for front exhaust or rear exhaust.

The disadvantage of a reversing valve mechanism is the complex construction, assembly, and high cost. Also the valve may permit leakage due to wear of the valve parts or incomplete closure. The disadvantage of the permanently front or rear exhausted tools is difficulty of conversion for alternate exhaust. Also, additional single use parts must be produced for each exhaust alternative.

Closely related to the exhaust configuration problem is the desirability of obtaining different motor speeds for the same motor construction. Typically this can be done by sizing and shaping an orifice in the fluid flow path to restrict fluid flow to a predetermined mass rate of flow, thus limiting motor speed. Again, speed regulation can be accomplished with a variable regulating valve or alternatively, with many single use permanent parts.

However, the disadvantages of the known speed regulating devices are similar to the flow reversing problems. A regulating valve is complex and subject to wear and partial operation. Permanent parts reduce the flexibility of converting the tool and create logistical problems in manufacturing the various parts. Both alternatives are costly to construct.

SUMMARY OF THE INVENTION

It is therefore an object of the present invention to provide fluid flow reversal and speed regulation for a fluid mechanism with simple and minimal number of parts.

It is another object of the present invention to provide a fluid flow reversal and speed regulation assembly having simple manufacture, assembly, and reversibility.

It is another object of the present invention to provide a single switch ring member having two opposed faces which provide forward exhaust in a first orientation and alternatively rear exhaust in a second orientation.

It is another object of the present invention to provide a fluid flow speed regulating member having a single part for either flow orientation.

It is another object of the present invention to provide a fluid flow speed regulating member integral with the fluid reversal member having simple construction, easy assembly, and easy exchange.

In one aspect of the present invention the above objects are accomplished by providing a fluid flow reversing and flow regulating ring for a fluid mechanism having a mechanism housing having circumferentially and axially extending primary and secondary fluid passageways. The control ring has two opposed axial faces. A first axial face has a thru slot and a circumferentially adjacent blocking flange. A second face has a fluid flow turning flange such that the flow turning flange is the reverse side of the flow blocking flange. Additionally, for regulating the fluid flow, an orifice in the fluid flow path has a predetermined area and configuration so as to create the desired fluid back pressure in the fluid flow path. The orifice of predetermined area is the fluid flow thru slot of the first face for the forward exhaust alignment or the cross sectional opening defined by the turning flange of the second face and the housing rib for the rear exhaust alignment.

The foregoing and other aspects of the present invention will become apparent from the following detailed description of the invention when considered in conjunction with the accompanying drawings. It must be understood, however, that the figures are not intended as definitions of the invention but are only for the purpose of illustration.

BRIEF DESCRIPTION OF THE DRAWINGS

FIG. 3 is a bottom schematic view representing the front exhaust mode of the present invention;

FIG. 4 is a bottom schematic view representing rear exhaust of the present invention;

FIG. 5 is a cross sectional view of FIG. 3 showing the fluid flow control area for the front exhaust alignment of the present invention; and FIG. 6 is an axial cross sectional view of FIG. 4 showing the flow control area for the rear exhaust alignment of the present invention.

DETAILED DESCRIPTION OF THE PREFERRED EMBODIMENT

Figure 1:
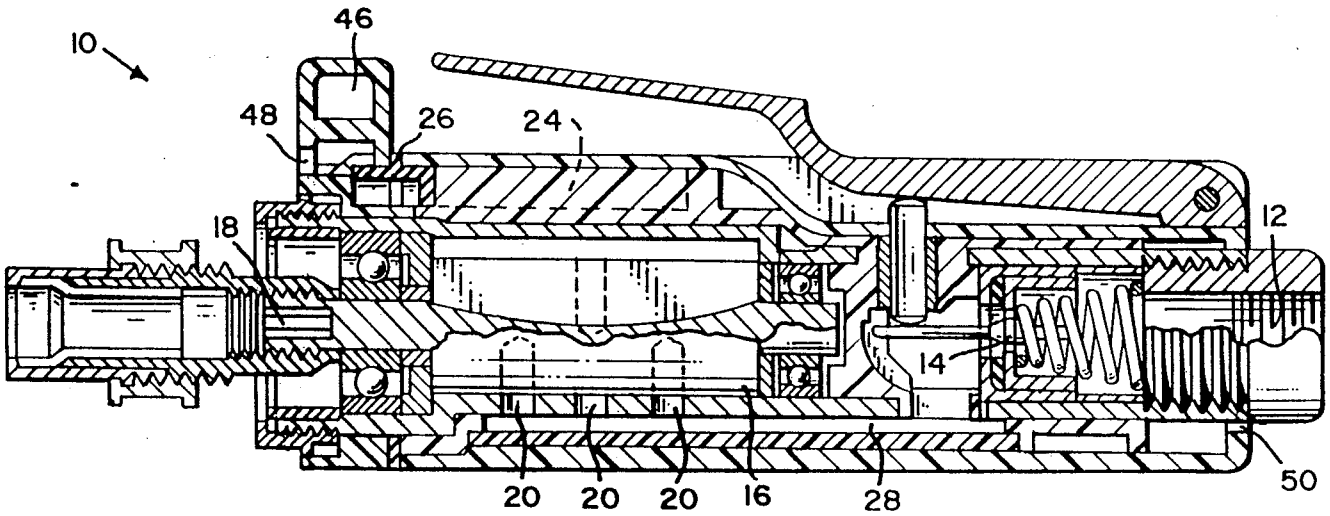
FIG. 1 is a cross sectional side view schematically illustrating a preferred embodiment of the fluid flow reversing and flow regulating ring of the present invention.

Referring now to FIG. 1, a handheld pneumatic power tool is disclosed. The tool includes a fluid inlet 12, a throttle control mechanism 14, and a fluid motor 16. A vane motor which produces rotary output for an output spindle 18 is shown, but the present invention can be adapted for any fluid powered motor.

The exhaust fluid from the vane motor exits the motor chamber by exhaust ports 20. From the exhaust ports the exhaust fluid is directed into a primary fluid passageway designated 24. The primary fluid passageway directs the fluid to a fluid flow control ring 26, best seen in FIG. 2.

The tool housing has two circumferentially adjacent and axially extending fluid passageways. As previously described the primary passageway 24 provides fluid communication from the exhaust ports to the control ring 26. A secondary fluid passageway 28 provides a fluid flow path to the rear of the tool.

The control ring 26 is substantially annular and has a central bore 30 sized to fit over the motor chamber cylinder. The control ring has two axially orientated opposed faces. A first face 32 has a thru slot 38 and a circumferentially adjacent flow blocking flange 40.

The second face 34 has a flow turning flange 42 that is gradually inclined through the plane of the ring. The flow turning flange 42 is the reverse side of the blocking flange 40 on the first face.

When the control ring 26 is positioned in the tool such that the first face 32 abuts the tool housing, as seen in FIG. 3, the thru slot 38 is aligned with the primary fluid passage 24. The fluid blocking flange 40 is therefore engaged with the secondary fluid passage 28. Thus fluid from the primary fluid passageway 24 continues to flow forward through the thru slot 38 into an exhaust flange assembly 44 which is axially engageable with the control ring 26. The flange assembly has a dispersal flow passage 46 in fluid communication with forward exhaust ports 48 for dispersing the exhaust fluid to the atmosphere.

Alternatively, when the control ring 26 is orientated in the opposite direction such that the second face 34 is axially abutting the housing, as seen in FIG. 4, the turning flange 42 is aligned with the primary fluid passageway 24 and turns the fluid flow into the secondary fluid passageway 28. The exhaust fluid flows to the rear of the tool and is exhausted at rear exhaust ports 50. The blocking flange 40 is engaged with the flange assembly 44 to block front exhaust.

The annular control ring 26 also regulates the mass rate of fluid flow through the tool. An orifice in the fluid flow path has a predetermined area so as to create fluid back pressure in the fluid flow path. For example, as shown in the schematic of FIG. 5, for a front exhaust configuration, the thru slot 38 can be constructed of different predetermined areas and configurations so as to create predetermined back pressures in the flow path so as to regulate the speed of the motor.

Alternatively, as best seen in FIG. 6, for a rear exhaust configuration, the orifice is the cross sectional area 54 defined by the turning flange 42 of the second face of the speed ring 26 and the face of the axial housing rib 56. Again, this opening can be constructed so as to create a predetermined back pressure to regulate the motor speed. It should be noted that while for a given ring, the thru slot 38 and the cross sectional opening 54 are of different absolute sizes, they are correlated so that the back pressures each orifice creates regulates the motor to a desired speed. Since the forward exhaust path length is only about one-seventh of that of the rearward exhaust path, it follows that, for a given mass flow rate, the forward exhaust passageway should have a smaller cross section than that of the rearward passageway. Thus a control ring 26 can be constructed so that in either the forward exhaust mode or the rear exhaust mode the control orifice 38 or 54 regulates the motor speed to the desired maximum speed.

Figure 2:
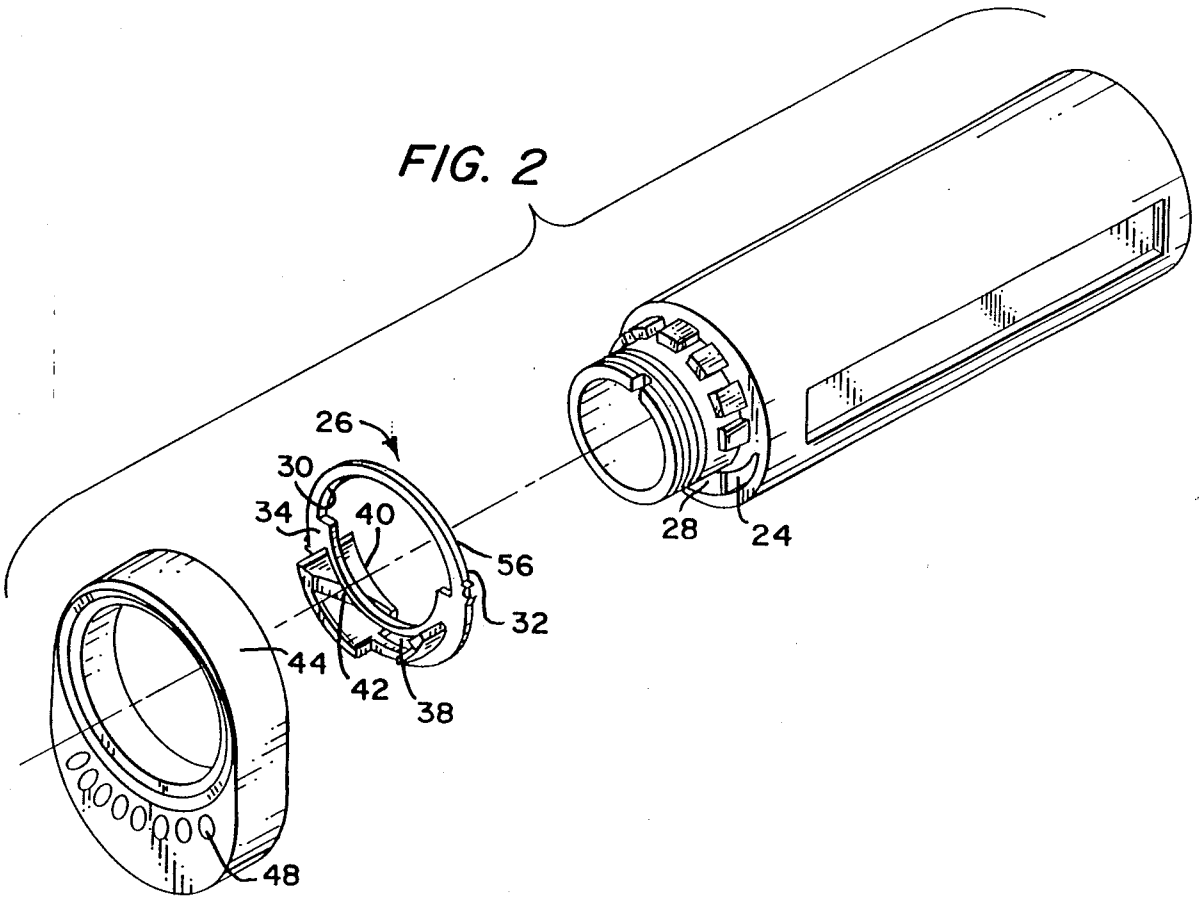
FIG. 2 is a front perspective view of the control ring and associated components of the present invention.

As best seen on the control ring of FIG. 2 the outer circumference which extends to the surface of the tool housing may contain an indicating means 58 which aligns with an indicator on the tool housing surface to indicate whether the tool is in the front exhaust mode or the rear exhaust mode. Additionally, the outer circumference of the control ring can be marked with additional indicating means such as a different color for example, to indicate the size of the speed regulating orifice. Each face of the control ring also has a raised sealing rib (not shown) to effect positive sealing with axially adjacent parts.

It should be noted that changes of exhaust direction and limit speeds using this invention require disassembly of the tool to reverse or to change the ring. It is contemplated that such changes would be made by a qualified tool maintenance mechanic—not by the operator. This would prevent inadvertent changes of speed and/or exhaust direction.

While this invention has been illustrated and described in accordance with a preferred embodiment related to a handheld pneumatic power tool, it should be recognized that variations and changes may be made herewith without departing from the invention as set forth in the following claims.

I claim:

1. A flow reversing assembly for control of exhaust fluid flow for a fluid mechanism comprising in combination:

a mechanism housing having circumferentially adjacent and axially extending primary and secondary fluid passageways;

a control ring member having two opposed faces comprising:

a first face having a thru slot in fluid communication with said primary passageway and a circumferentially adjacent blocking flange; and a second face having a turning flange to direct exhaust flow to said secondary fluid passageway such that said turning flange is the reverse of said blocking flange.

2. The flow reversing assembly of claim 1 wherein said fluid flow is directed in a first axial direction in said fluid mechanism by axially abutting said first face to said mechanism housing such that the thru slot is aligned with said primary fluid passageway.

3. The flow reversing assembly of claim 2 wherein said blocking flange is engaged with said secondary fluid passageway.

4. The flow reversing assembly of claim 3 further comprising means for indicating the alignment of the control ring on an exterior surface of said control ring.

5. The flow reversing assembly of claim 2 further comprising a thru flow flange assembly axially engageable with said control ring and having a dispersing flow passage in fluid communication with said thru slot of said control ring and the primary fluid passageway of said fluid mechanism.

6. The flow reversing assembly of claim 1 wherein said fluid flow is directed in a second axial direction in said fluid mechanism by axially abutting said second face to said mechanism housing such that the turning flange is aligned with said primary fluid passageway and said secondary fluid passageway.

7. The flow reversing assembly of claim 6 further comprising means for indicating the alignment of the control ring on an outer circumferential surface of said control ring.

8. The flow reversing assembly of claim 1 wherein said control ring further comprises means for regulating the mass rate of fluid flow in the fluid passageways.

9. The flow reversing assembly of claim 8 wherein said regulating means comprises means for regulating the fluid back pressure in the fluid flow path.

10. The flow reversing assembly of claim 9 wherein; the regulating means comprises a control orifice of a predetermined area in the fluid flow path.

11. The flow reversing assembly of claim 10 wherein the control orifice is the thru slot in the first face.

12. The flow reversing assembly of claim 10 wherein the control orifice is the cross sectional opening defined by said turning flange of said second face and a housing rib.

13. An exhaust flow reversing member for a fluid mechanism comprising:

an annular ring having two opposed faces;

a first face having a flow thru slot and a circumferentially adjacent flow blocking flange; and a second face having a flow turning flange such that said turning flange is the reverse of said blocking flange.

14. The flow reversing ring of claim 13 wherein said flow turning flange is the reverse side of said flow blocking flange.

15. The flow reversing ring of claim 14 further comprising an outer circumferential surface of the ring having means for indicating the alignment of the flow reversing ring.

16. An annular ring member in a fluid mechanism for regulating the fluid flow comprising:

means defining an orifice in said annular ring member in the fluid flow path having a predetermined area and configuration so as to create fluid back pressure in the fluid flow path;

said annular ring member further comprising two opposed axial faces such that:

a first face has a flow thru slot and a circumferentially adjacent flow blocking flange; and a second face having a flow turning flange wherein said flow turning flange is the reverse side of said flow blocking flange.

17. The annular ring member of claim 16 further comprising a circumferential surface having means for indicating magnitude of the predetermined area of the orifice.

18. The annular ring member of claim 17 wherein; the means for indicating magnitude of the predetermined area of said orifice is the color of said ring.

19. The annular ring member of claim 16 wherein the orifice is the thru slot in the first face.

20. The annular ring member of claim 16 wherein the orifice is the cross sectional opening defined by said turning flange of said second face and a housing rib.

21. The annular ring member of claim 16 further comprising; an indicator means on the outer circumferential surface to indicate direction of exhaust flow.

* * * * *